US005674109A

United States Patent [19]

Kanzawa et al.

[11] Patent Number: 5,674,109

[45] Date of Patent: Oct. 7, 1997

[54] APPARATUS AND METHOD FOR POLISHING WORKPIECE

[75] Inventors: Morihito Kanzawa; Norio Kimura, both of Fujisawa, Japan

[73] Assignee: Ebara Corporation, Tokyo, Japan

[21] Appl. No.: 527,421

[22] Filed: Sep. 13, 1995

[51] Int. Cl.[6] ..... B24B 1/00

[52] U.S. Cl. ..... 451/41; 451/285; 451/286; 451/287; 451/288; 451/289; 451/290

[58] Field of Search ..... 451/41, 36, 285, 451/287–289, 283, 394, 398

[56] References Cited

PUBLICATIONS

Surfacetech Review, vol. 1, Issue 9, Aug. 1990, "A Study of Polishing Pad Dynamics".

*Primary Examiner*—Robert A. Rose
*Assistant Examiner*—George Nguyen
*Attorney, Agent, or Firm*—Wenderoth, Lind & Ponack

[57] ABSTRACT

A polishing apparatus has a circular abrasive cloth on a turntable, and a top ring for holding a workpiece and pressing the workpiece against the circular abrasive cloth to polish the workpiece while the circular abrasive cloth is rotated about a center axis and the workpiece is rotated by the top ring about a top ring axis located at a positioned spaced from the center axis. The position is spaced from the center axis by a distance rc, and the workpiece has a radius rw. When the workpiece is not angularly moved with respect to the circular abrasive cloth wile the workpiece is being polished, a ratio Rc=rc/rw is in a range from 1.10 to 2.60. When the workpiece is angularly moved at a radius rs through an angular displacement ø (degrees) in arcuate reciprocating motions with respect to the circular abrasive cloth, a ratio Rs=rs/rw, the angular displacement ø, and the ratio Rc are selected to be of a certain relationship.

4 Claims, 4 Drawing Sheets

APPARATUS AND METHOD FOR POLISHING WORKPIECE

BACKGROUND OF THE INVENTION

1. Field of the Invention

The present invention relates to an apparatus and method for polishing a workpiece, and more particularly to an apparatus and method for polishing a workpiece such as a semiconductor wafer to a flat mirror finish.

2. Description of the Related Art

Recent rapid progress in semiconductor device integration demands smaller and smaller wiring patterns or interconnections and also narrower spaced between interconnections which connect active areas. One of the processes available for forming such interconnections is photolithography. Though the photolithographic process can form interconnections that are at most 0.5 μm wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

As shown in FIG. 1, such a polishing apparatus has a turntable 1 and a top ring 4 which rotate at respective individual speeds. An abrasive cloth 2 is attached to the upper surface of the turntable 1. A workpiece 3 such as a semiconductor wafer to be polished is placed on the abrasive cloth 2 and clamped between the top ring 4 and the turntable 1. During a polishing operation, the top ring 4 exerts a pressure on the turntable 1, and an abrasive slurry Q is supplied from a nozzle 6 over the abrasive cloth 2. The abrasive slurry is interposed between the abrasive cloth 2 and the workpiece 3. The lower (front) surface of the workpiece 3 held against the abrasive cloth 2 is therefore polished while the top ring 4 and the turntable 1 are rotating. FIG. 2A is a plan view showing the polishing apparatus of FIG. 1, and FIG. 2B is a graph showing distances of the relative sliding movement of the abrasive cloth at respective radial positions. As described below, L represents the distance of relative sliding movement of the abrasive cloth against the workpiece, and S represents the distance of relative sliding movement of the workpiece against the abrasive cloth. During the polishing process, an arm 5 which supports the top ring 4 may be swung, for example, in arcuate reciprocating motions as shown in FIG. 2A, so as not to localize wear or loading at particular radial positions of the abrasive cloth 2.

For increasing the flatness of workpiece 3 that is being polished, it is important that pressing forces applied against the workpiece 3 be uniform in the polishing process and that the speed of sliding movement between the abrasive cloth 2 and the workpiece 3 be made uniform over the entire surface of the workpiece 3. Heretofore, it has been proposed to meet the former requirement with an apparatus which applies a pressing force to the top ring 4 through a spherical seat (see, for example, Japanese laid-open patent publications Nos. 2-278822 and 4-19065) or with an apparatus which holds a workpiece by an attracting force under vacuum (see, for example, Japanese patent application No. 5-256522). To meet the latter requirement, it has been well known in the art that the abrasive cloth 2 and the workpiece 3 are rotated at the same rotational speed and in the same direction. When the arm 5 is swung, if the speed of swinging movement of the arm 5 is reduced to a level sufficiently lower than the rotational speed of the workpiece 3, the speed of sliding movement between the abrasive cloth 2 and the workpiece 3 is made sufficiently uniform.

The thickness of the portion of workpiece 3 that can be removed by polishing is substantially proportional to the product of the speed of relative movement of the workpiece 3 and the abrasive cloth 2 and the period of time over which the workpiece 3 is polished. That is, the thickness of the portion of workpiece 3 that can be removed by polishing is substantially proportional to the distance S over which the workpiece 3 slides against the abrasive cloth 2. Since the abrasive cloth 2 and the workpiece 3 are generally rotated at substantially the same rotational speed and in the same direction, the distance S over which the workpiece 3 slides against the abrasive cloth 2 is uniform on the entire surface of the workpiece 3 which is polished. On the contrary, as shown in FIGS. 2A and 2B, the distances L of relative sliding movement of the abrasive cloth against the workpiece at respective radial positions are not uniform according to the radial position of the abrasive cloth 2. This is because the arc length of the workpiece 3 at a radial position r from the center O of the abrasive cloth 2 differs with the radial position r. Along the radius rp of the abrasive cloth 2, a radially inner area between O and Oi ($r \leqq ri$) and a radially outer area between Oo and B ($r \geqq rp-ro$) of the abrasive cloth 2 are not held in contact with the workpiece 3, and there is an area where the distance L of relative sliding movement of the abrasive cloth against the workpiece is of a maximum value Lmax ($r=rm$) between Oi and Oo ($\Delta t=ro-ri$); $\Delta r$ represents the width of the annular area of the abrasive cloth where polishing is performed.

The degradation of the abrasive cloth 2, due to wear or loading thereof, is substantially proportional to the distance L of relative sliding movement of the abrasive cloth 2. Therefore, the polishing capability of the abrasive cloth 2 is most reduced at a radial position thereof in the vicinity of the radius $r=rm$, with the result that the workpiece 3 tends to be finished into a convex surface. That is, the amount removed by polishing in the peripheral portion of the workpiece 3 is larger than that of the central portion of the workpiece 3. To avoid such a drawback, it is necessary to carry out dressing of the abrasive cloth 2. However, non-uniformity of degradation of the abrasive cloth 2 leads to increase of the frequency of or time for dressing. As a result, the service life of the abrasive cloth 2 is shortened.

If the radius of the abrasive cloth 2 is increased to displace the central position Oc or Ow of the workpiece 3 to a sufficiently large radial position or to sufficiently increase the amplitude of swinging movement of the workpiece 3, then the distance L of relative sliding movement of the abrasive cloth is reduced, and the difference of the distance L of relative sliding movement of the abrasive cloth due to radial positions on the abrasive cloth 2 is also reduced. However, such an arrangement requires a much larger abrasive cloth, resulting in the polishing apparatus being very large size.

Consequently, it has been desired to reduce the distance L of relative sliding movement of the abrasive cloth and also the difference of the distance L of relative sliding movement of the abrasive cloth due to radial positions on the abrasive cloth, without increasing the size of the abrasive cloth in order to provide a polishing apparatus which is not very large in size and which is capable of polishing a workpiece to a highly flat finish with an abrasive cloth of prolonged service life.

SUMMARY OF THE INVENTION

It is therefore an object of the present invention to provide an apparatus and method for polishing a workpiece in which a distance of relative sliding movement of an abrasive cloth against the workpiece is reduced and also in which a difference of the distance of relative sliding movement of the abrasive cloth due to different radial position of the workpiece on the abrasive cloth is reduced.

According to a first aspect of the present invention, there is provided an apparatus for polishing a surface of a workpiece having a substantially circular shape with a radius rw. The apparatus includes a turntable, a circular abrasive cloth mounted on an upper surface of the turntable, and a top ring positioned above the turntable for supporting the workpiece to be polished and pressing the workpiece against the abrasive cloth. The circular abrasive cloth is rotated about a center axis, and the workpiece is rotated by the top ring about a position or axis spaced from such center axis. Such position is spaced from the center axis by a distance rc, a ratio Rc=rc/rw is in a range from 1.10 to 2.60, and the workpiece is not angularly moved with respect to the circular abrasive cloth while the workpiece is being polished.

According to a second aspect of the present invention, the workpiece is angularly moved at a radius rs through an angular displacement ø (degrees) in arcuate reciprocating motions with respect to the circular abrasive cloth. The workpiece has an axis at a position spaced from the center axis by a distance rc centrally of the angular displacement ø. The arrangement is such that a ratio Rs=rs/rw, the angular displacement ø, and the ratio Rc=rc/rw are selected to fall within a space surrounded by curved surfaces which pass through the following fifteen points represented in an Rc–Rs–ø three-dimensional orthogonal coordinate system:

| | |
|---|---|
| (1.10, 1.50, 0), | (1.60, 1.50, 0), |
| (2.60, 1.50, 0), | (1.10, 2.10, 0), |
| (1.60, 2.60, 0), | (2.60, 3.60, 0), |
| (1.10, 1.56, 20), | (1.60, 1.54, 20), |
| (2.45, 1.53, 20), | (1.15, 2.16, 20), |
| (1.60, 2.71, 34), | (2.35, 3.44, 20), |
| (1.20, 1.69, 40), | (1.60, 1.80, 52), |
| (2.25, 1.66, 40). | |

According to a third aspect of the invention, there is provided a method for polishing a surface of a workpiece having a substantially circular shape with a radius rw. The method includes positioning the workpiece between a turntable with a circular abrasive cloth mounted on an upper surface thereof and a top ring positioned above the turntable, rotating the turntable and the top ring, and pressing the workpiece against the abrasive cloth by the top ring. The circular abrasive cloth is rotated about a center axis, and the workpiece is rotated by the top ring about an axis at a position spaced from the center axis by a distance rc. A ratio Rc=rc/rw is in the range from 1.10 to 2.60, and the workpiece is not angularly moved with respect to the circular abrasive cloth while the workpiece is being polished.

According to a fourth aspect of the invention, the circular abrasive cloth is rotated about a center axis, and the workpiece is rotated by the top ring about an axis at a position spaced from the center axis. The workpiece is angularly moved at a radius rs through an angular displacement ø (degrees) in arcuate reciprocating motions with respect to the circular abrasive cloth. The position is spaced from the center axis by a distance rc centrally in the angular displacement ø. The arrangement is such that a ratio Rs–rs/rw, the angular displacement ø, and the ratio Rc=rc/rw are selected to fall within a space surrounded by curved surfaces which pass through the following fifteen points represented in an Rc–Rs–Ø three-dimensional orthogonal coordinate system:

| | |
|---|---|
| (1.10, 1.50, 0), | (1.60, 1.50, 0), |
| (2.60, 1.50, 0), | (1.10, 2.10, 0), |
| (1.60, 2.60, 0), | (2.60, 3.60, 0), |
| (1.10, 1.56, 20), | (1.60, 1.54, 20), |
| (2.45, 1.53, 20), | (1.15, 2.16, 20), |
| (1.60, 2.71, 34), | (2.35, 3.44, 20), |
| (1.20, 1.69, 40), | (1.60, 1.80, 52), |
| (2.25, 1.66, 40). | |

If a maximum value Lmax/S of the distance L of relative sliding movement of the abrasive cloth against the workpiece per distance S of relative sliding movement of the workpiece against the abrasive cloth is to be reduced, then it is necessary to increase the size of the abrasive cloth. The abrasive cloth is degraded to a greatest degree at the position of the radius rw where the distance of relative sliding movement of the abrasive cloth is maximum. Therefore, a demand for an increased service life of the abrasive cloth and a polishing process for achieving a higher degree of flatness, and a demand for a reduced abrasive cloth size are contradictory to each other. It is thus desirable to select the diameter of the abrasive cloth, the eccentricity of the workpiece from the center of the abrasive cloth, the angular displacement of the workpiece, and the radius of angular movement of the workpiece in an optimum combination. Although the maximum value Lmax of the distance of relative movement of the abrasive cloth corresponds to the degree to which the abrasive cloth is degraded, in order to make Lmax dimensionless, Lmax is divided by the distance S of relative sliding movement of the workpiece.

The above and other objects, features and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
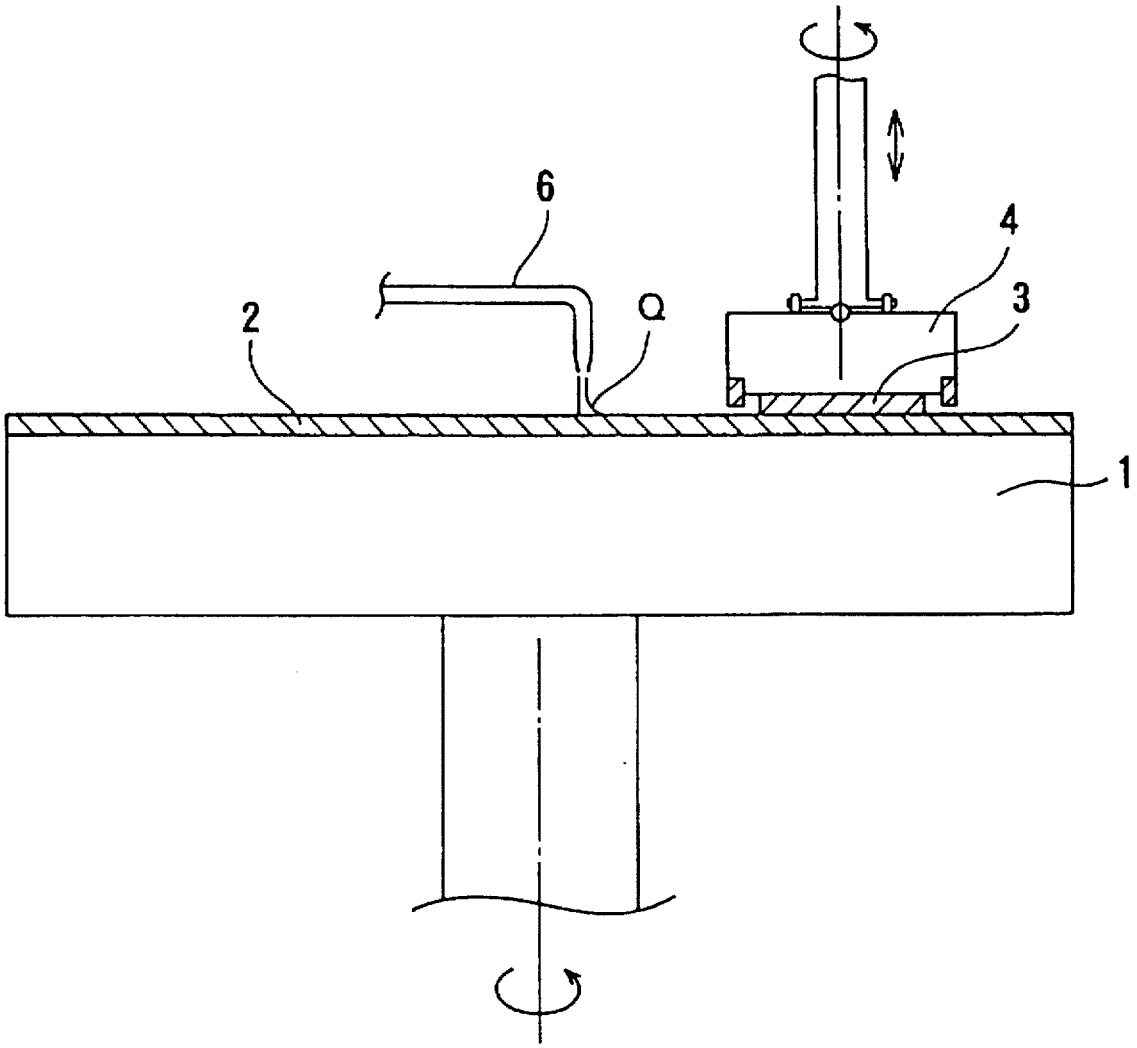
FIG. 1 is a side view of a basic structure of polishing apparatus.
Figure 2A:
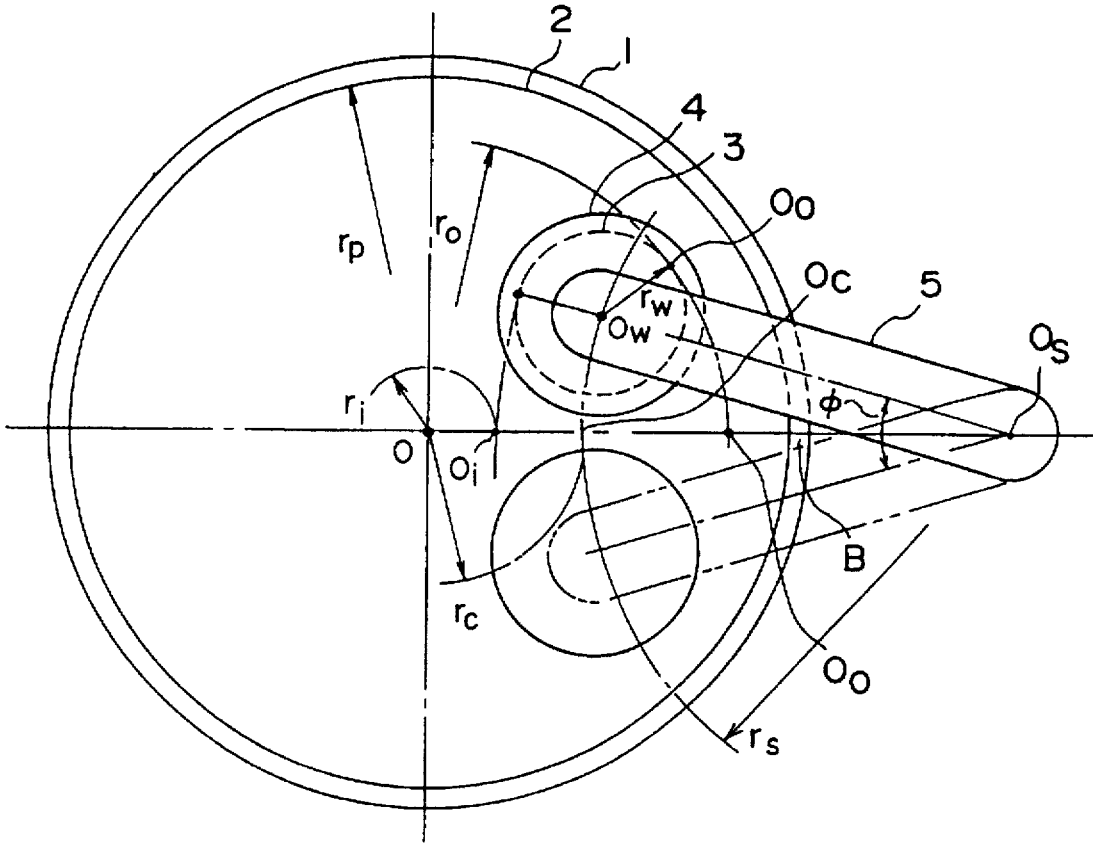
FIG. 2A is a plan view of a basic structure of a polishing apparatus.
Figure 2B:
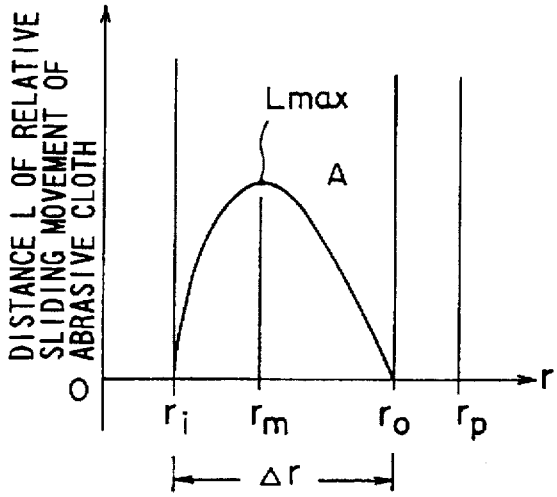
FIG. 2B is a graph showing distances L of relative sliding movement at respective radial positions on an abrasive cloth in FIG. 2A.

A basic structure of a polishing apparatus according to the present invention is the same as that of the conventional polishing apparatus shown in FIGS. 1 and 2A. Therefore, the description of the conventional polishing apparatus will be referred to in the description of the polishing apparatus according to the present invention which follows.

The polishing apparatus according to the present invention provides a minimum required radius ro of the abrasive cloth 2 from a center axis o, an eccentricity rc of the workpiece 3 between center axis O and a position Oc of closest spacing of top ring axis Oo to center axis O, an angular displacement ø of the workpiece 3, and a radius rs of swinging movement of top ring axis Oo and the workpiece 3 that are selected in order to minimize the produce of Lmax/S which corresponds to the degree to which the abrasive cloth 2 is degraded and $Ko^2$ which is representative of the area of the abrasive cloth 2.

Figure 3:
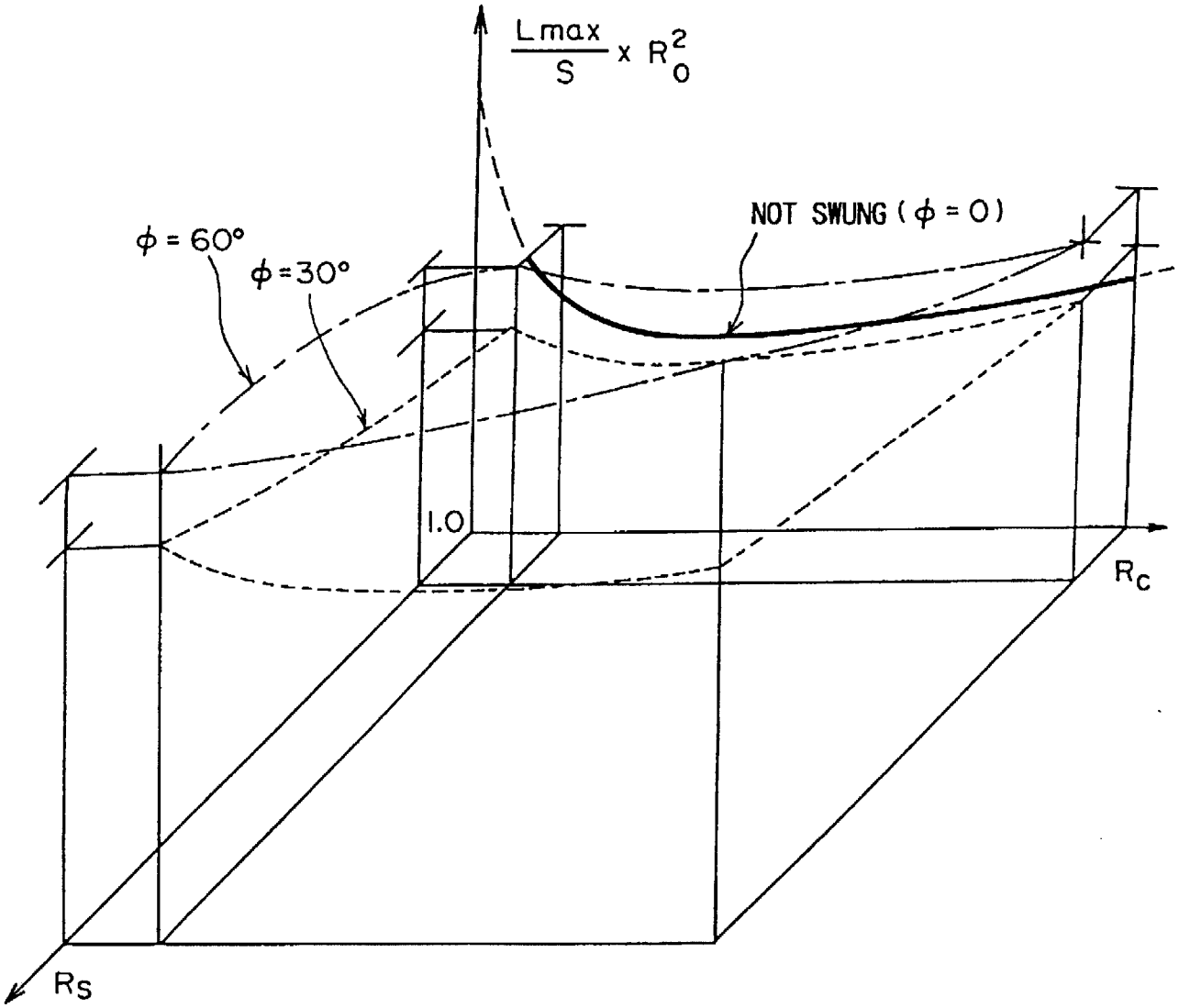
FIG. 3 is a diagram showing dimensions or parameters of polishing apparatus according to the present invention and the relationship between a swinging operation and $(Lmax/S)\times Ro^2$.

If it is assumed that the number of swinging motions of the workpiece 3 per unit time is ⅕ of and number of rotations of the workpiece 3 which is equal to the number of rotations of the abrasive cloth 2, then eccentricity Rc (=rc/rw), radius Rs (=rs/rw), minimum required radius Ro (=ro/rw) of the abrasive cloth 2, which quantities are all made dimensionless by division by radius rw, of the workpiece 3, the angular displacement ø of the workpiece 3, the Lmax/S are related as shown in FIG. 3. The workpiece 3 is angularly moved at a constant speed during ⅓ of one cycle of its angular movement, at a constant acceleration and deceleration in ⅙ of one cycle of its angular movement.

$(Lmax/S)\times Ro^2$ is represented by a plain curve with Rc as a variable, as indicated by the thick solid line in FIG. 3, when the workpiece 3 is not swung or angularly moved (ø=O). Further, $(Lmax/S)\times Ro^2$ is represented by a curved surface with Rc, Rs and ø as variables, as indicated by the dotted lines in FIG. 3 for ø=30° and by the dot-and-dash lines in FIG. 3 for ø=60°, when the workpiece 3 is swung or angularly moved. In each of these cases, $(Lmax/S)\times Ro^2$ has a minimum value. The variables Rc, Rs and ø in the case where $(Lmax/S)\times Ro^2$ is minimum become optimum conditions to be satisfied for reducing both Lmax/S which corresponds to the degree to which the abrasive cloth 2 is degraded, and $Ro^2$ which corresponds to the area of the abrasive cloth 2. In order to allow the workpiece 3 to be attached and detached with ease and also allow commercially available materials to be used, Rc, Rs and ø should be selected with certain freedom, and an increase by 10% from the minimum value of $(Lmax/S)\times Ro^2$ should be permitted. Ranges of Rc, Rs and ø which meet the above requirements are contained within a space that is surrounded by envelopes including lines $Y_1$, $Y_2$, $Y_3$, $Y_4$, $Y_5$ (indicated by the dot-and-dash lines) shown in FIG. 4.

In selecting Rc, Rs and ø, it is necessary to take into account the thickness of the shaft (not shown) of the arm 5 which supports or angularly moves the workpiece 3 and the thickness of the outer circumferential edge of the top ring 4 which holds the workpiece 3. Therefore, a lower limit for rs is limited by providing that the distance between the required radius ro of the abrasive cloth 2 and the rotating axis Os of the arm 5 is equal to 0.5 rw or greater. An upper limit for rs is also limited to a value equal to or less than the required radius ro of the abrasive cloth 2 because if the length of the arm 5 were unduly large, the size of the polishing apparatus would be increased undesirably.

Figure 4:
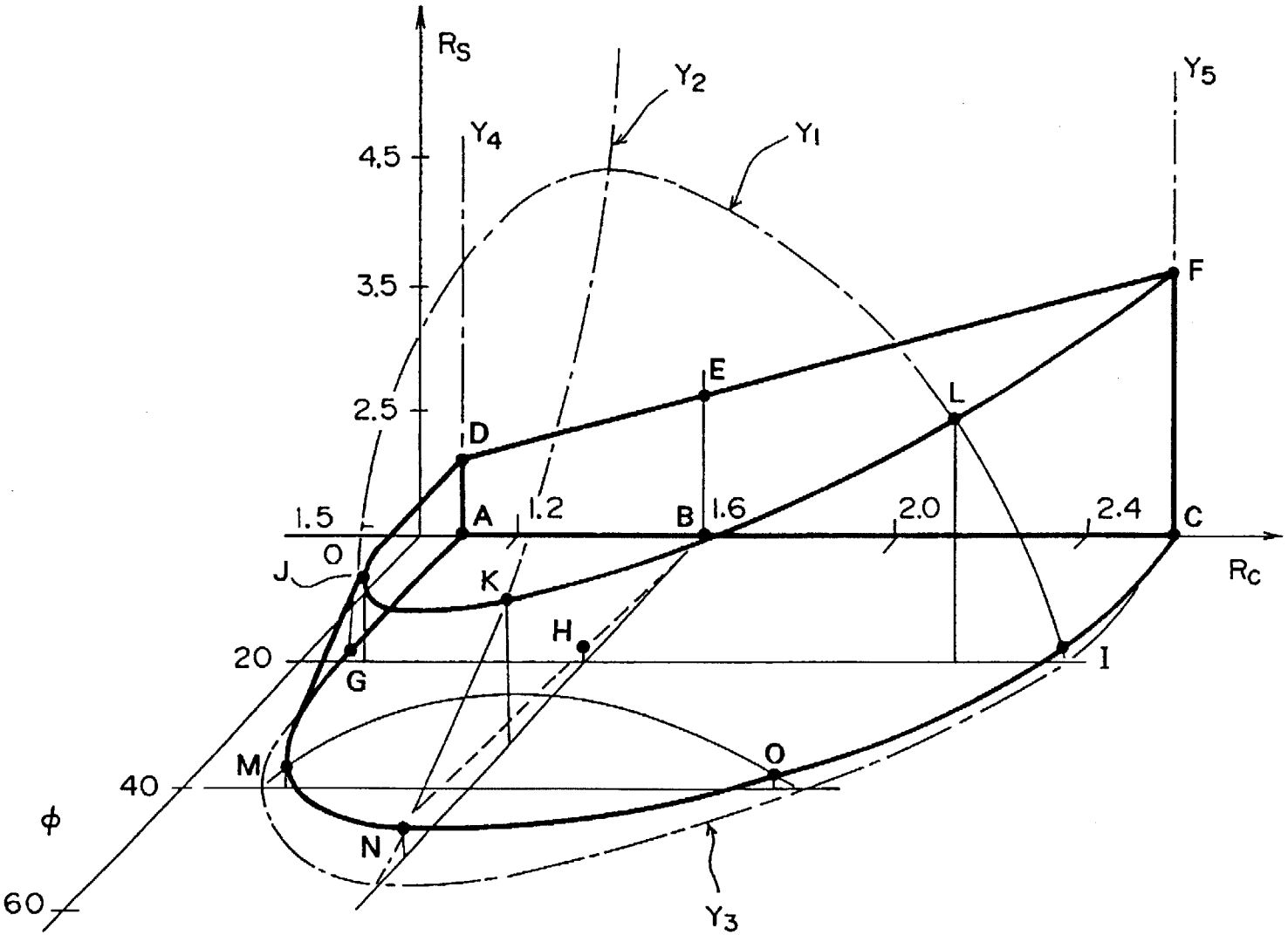
FIG. 4 is a diagram showing an appropriate range of dimensions or parameters of the polishing apparatus according to the present invention.

The ranges of Rc, Rs and ø represented by the envelopes (indicated by the dot-and-dash lines in FIG. 4) as rs is within the above limits fall within a space indicated by the thick solid lines in FIG. 4. The coordinates of points A–O on space boundaries indicated by the thick solid lines are represented in an Rc-Rs-ø three-dimensional orthogonal coordinate system as follows:

| | |
|---|---|
| A: (1.10, 1.50, 0), | B: (1.60, 1.50, 0), |
| C: (2.60, 1.50, 0), | D: (1.10, 2.10, 0), |
| E: (1.60, 2.60, 0), | F: (2.60, 3.60, 0), |
| G: (1.10, 1.56, 20), | H: (1.60, 1.54, 20), |
| I: (2.45, 1.53, 20), | J: (1.15, 2.16, 20), |
| K: (1.60, 2.71, 34), | L: (2.35, 3.44, 20), |
| M: (1.20, 1.69, 40), | N: (1.60, 1.80, 52), |
| O: (2.25, 1.66, 40). | |

When Rc, Rs and ø are selected to fall in the space surrounded by the coordinates of the points A–O, it is possible to reduce the product of the distance of relative sliding movement of the abrasive cloth 2 corresponding to the degree to which the abrasive cloth 2 is degraded, and the area of the abrasive cloth 2, and hence it is possible to simultaneously reduce the size and degradation of the abrasive cloth 2.

More specifically, when the workpiece 3 is not swung, Rc is selected to fall in a range indicated by the straight line A–C in FIG. 4, i.e., $1.1 \leqq Rc \leqq 2.6$. When the workpiece 3 is swung, Rc, Rs and ø are selected to fall within the space A–O in FIG. 4.

Example

For polishing a silicon wafer having a radius rw=100 mm and coated with a layer of silicon dioxide ($SiO_2$) to a mirror finish, a polishing apparatus with rc=150 mm, rs=250 mm, and ø=22 degrees in FIG. 2A was used, and rc/rw=Rc, rs/rw=Rs, and ø were selected to fall within the space A–O in FIG. 4. A sheet of non-woven fabric of polyester impregnated with polyurethane, having a Shore D hardness of 73, was used as an abrasive cloth on the turntable 1, and an aqueous suspension of 0.5% of fine particles of selenlumoxide was used as an abrasive slurry. The layer of $SiO_2$ on the silicon wafer was polished to a mirror finish by rotating the top ring 4 and the abrasive cloth 2 at 100 rpm, swinging the arm 5 in periodic cycles of 5 seconds, and pressing the silicon wafer against the abrasive cloth 2 under a pressure of 300 g/cm$^2$.

As a result, the layer of $SiO_2$ was polished, at a polishing rate ranging from 3500 to 4000 angstroms/minute, and variations of the thickness of the remaining layer of $SiO_2$ after polishing were in the range of from 10 to 15% on the average at 18 spots in the wafer surface. Therefore, the silicon wafer was well polished to a high degree of flatness.

After the polishing process, the surface of the abrasive cloth was cleaned and dressing of the abrasive cloth was carried out by clean water. After the abrasive cloth 2 was used in cyclic times of 3 minutes over a total of 120 minutes, no significant differences were appreciated with respect to the flatness and polishing rate of the workpieces, and no signs of accelerated degradations at a particular radial position on the abrasive cloth 2 were recognized by way of visual and electron microscope observations.

As is apparent from the foregoing description, according to the present invention, the eccentricity rc of the center of the workpiece 3 with respect to the abrasive cloth 2, the radius rs of swinging movement of the workpiece 3 about center Os, and the angular displacement ø of the workpiece 3 are established such that the product of the maximum value Lmax of the distance of relative movement of the abrasive cloth 2 per distance S of relative movement of the workpiece 3, i.e., the parameter Lmax/S corresponding to the degree to which the abrasive cloth 2 is degraded (if the degradation of the abrasive cloth at a particular radial position thereon is increased, the flatness of the workpiece 3 is impaired), and the square ($Ro^2$) of the ratio Ro (=ro/rw)

between the required radius ro of the abrasive cloth 2 and the radius rw of the workpiece 3, which corresponds to the area of the abrasive cloth 2, falls within 1.1 times the minimum value thereof. Consequently, the distance of relative sliding movement of the abrasive cloth 2 and also the difference of the distance of relative sliding movement of the abrasive cloth 2 due to radial positions on the abrasive cloth 2 can be reduced with the abrasive cloth 2 being of moderate size. Therefore, the degrees of flatness of polished workpieces can be stable for a long period of time, and the service life of the abrasive cloth 2 is long.

Although a certain preferred embodiment of the present invention has been shown and described in detail, it should be understood that various changes and modifications may be made therein without departing from the scope of the appended claims.

What is claimed is:

1. An apparatus for polishing a surface of a workpiece having a substantially circular shape with a radius rw, said apparatus comprising:

a turntable having an upper surface;

a circular abrasive cloth mounted on said upper surface of said turntable and rotatable thereby about a center axis;

a top ring for supporting a workpiece to be polished and for pressing the workpiece against said abrasive cloth, said top ring being mounted above said abrasive cloth for rotation about a top ring axis that is located at a position that is fixed relative to said center axis, and said top ring being rotatable at said position such that, as said abrasive cloth is rotated about said center axis and as said top ring is rotated about said top ring axis at said fixed position and presses the workpiece against said abrasive cloth, the workpiece is polished; and said position being spaced from said center axis by a distance rc, wherein a ratio Rc=rc/rw is in a range of from 1.10 to 2.60.

2. An apparatus for polishing a surface of a workpiece having a substantially circular shape with a radius rw, said apparatus comprising:

a turntable having an upper surface;

a circular abrasive cloth mounted on said upper surface of said turntable and rotatable thereby about a center axis;

a rotatable top ring for supporting a workpiece to be polished and for pressing the workpiece against said abrasive cloth; and means for mounting said top ring above said abrasive cloth for rotation about a top ring axis located at a position spaced from said center axis and for angularly moving said top ring in arcuate reciprocating motions in opposite directions from said position through an angular displacement ø about a center spaced by a radius rs from said position, said position being spaced from said center axis by a distance rc centrally of said angular displacement ø, wherein a ratio Rs=rs/rw, said angular displacement ø, and a ratio Rc=rc/rw are selected to fall within a space surrounded by curved surfaces which pass through the following fifteen points represented in an Rc-Rs-ø three-dimensional orthogonal coordinate system:

| | |
|---|---|
| (1.10, 1.50, 0), | (1.60, 1.50, 0), |
| (2.60, 1.50, 0), | (1.10, 2.10, 0), |
| (1.60, 2.60, 0), | (2.60, 3.60, 0), |
| (1.10, 1.56, 20), | (1.60, 1.54, 20), |
| (2.45, 1.53, 20), | (1.15, 2.16, 20), |
| (1.60, 2.71, 34), | (2.35, 3.44, 20), |
| (1.20, 1.69, 40), | (1.60, 1.80, 52), |
| (2.25, 1.66, 40). | |

3. A method for polishing a surface of a workpiece having a substantially circular shape with a radius rw, said method comprising the steps of:

positioning said workpiece between a turntable with a circular abrasive cloth mounted on an upper surface thereof and a top ring positioned above said turntable;

pressing said surface of said workpiece by said top ring against said abrasive cloth while rotating said turntable and said abrasive cloth about a center axis and rotating said top ring and said workpiece about a top ring axis located at a fixed position spaced from said center axis, thereby polishing said surface of said workpiece; and providing that said fixed position is spaced from said center axis by a distance rc, and that a ratio Rc=rc/rw is in a range from 1.10 to 2.60, and that said workpiece is not angularly moved with respect to said circular abrasive cloth while said workpiece is being polished.

4. A method for polishing a surface of a workpiece having a substantially circular shape with a radius rw, said method comprising the steps of:

positioning said workpiece between a turntable with a circular abrasive cloth mounted on an upper surface thereof and a top ring positioned above said turntable;

pressing said surface of said workpiece by said top ring against said abrasive cloth while rotating said turntable and said abrasive cloth about a center axis and rotating said top ring and said workpiece about a top ring axis located at a position spaced from said center axis; and moving said top ring and said workpiece angularly in arcuate reciprocating motions in opposite directions from said position through an angular displacement ø about a center spaced by a radius rs from said position, providing that said position is spaced from said center axis by a distance rc centrally of said angular displacement ø, and that a ratio Rs=rs/rw, said angular displacement ø, and a ratio Rc=rc/rw are selected to fall within a space surrounded by curved surfaces which pass through the following fifteen points represented in an Rc-Rs-ø three-dimensional orthogonal coordinate system:

| | |
|---|---|
| (1.10, 1.50, 0), | (1.60, 1.50, 0), |
| (2.60, 1.50, 0), | (1.10, 2.10, 0), |
| (1.60, 2.60, 0), | (2.60, 3.60, 0), |
| (1.10, 1.56, 20), | (1.60, 1.54, 20), |
| (2.45, 1.53, 20), | (1.15, 2.16, 20), |
| (1.60, 2.71, 34), | (2.35, 3.44, 20), |
| (1.20, 1.69, 40), | (1.60, 1.80, 52), |
| (2.25, 1.66, 40). | |

* * * * *